United States Patent [19]

Pearsall

[11] 4,315,334

[45] Feb. 16, 1982

[54] DUAL PURPOSE COAT

[76] Inventor: Wally Pearsall, 110 E. 9th St., Los Angeles, Calif. 90015

[21] Appl. No.: 93,377

[22] Filed: Nov. 13, 1979

[51] Int. Cl.[3] ..... A41B 3/02

[52] U.S. Cl. ..... 2/85

[58] Field of Search ..... 2/84, 85, 87, 88, 89

[56] References Cited

U.S. PATENT DOCUMENTS

| | | | |
|---|---|---|---|
| 586,132 | 7/1897 | Lane | 2/88 |
| 1,236,689 | 8/1917 | Doubles | 2/88 |
| 1,368,835 | 2/1921 | Place | 2/87 |
| 2,380,909 | 7/1945 | Jackson | 2/84 |
| 2,971,198 | 2/1961 | Tomica | 2/84 |

FOREIGN PATENT DOCUMENTS

| | | | |
|---|---|---|---|
| 239296 | 10/1911 | Fed. Rep. of Germany | 2/88 |
| 309731 | 4/1929 | United Kingdom | 2/87 |
| 780512 | 8/1957 | United Kingdom | 2/87 |

*Primary Examiner*—Doris L. Troutman

*Attorney, Agent, or Firm*—Lewis Anten

[57] ABSTRACT

A dual purpose coat capable of being worn or folded and inserted into the capelette of the coat for convenient storage during travel is disclosed. The coat includes a belt which may be used as an adjustable carrying strap for transporting the folded coat. A method for folding the coat is also disclosed.

5 Claims, 7 Drawing Figures

FIG. 1
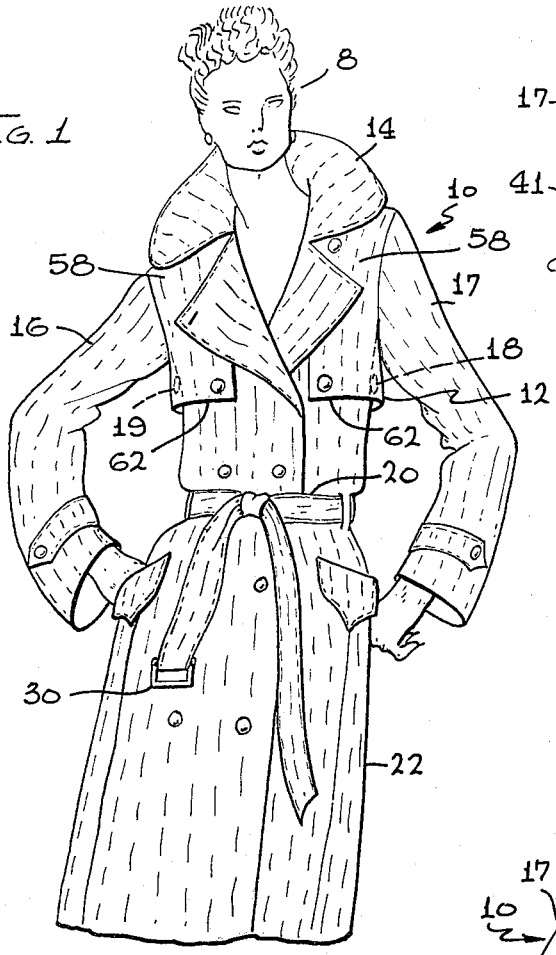
FIG. 4
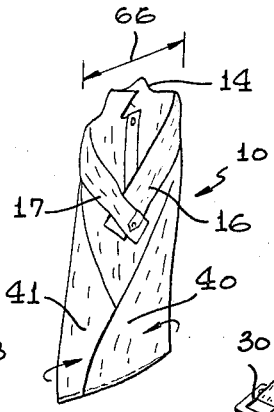
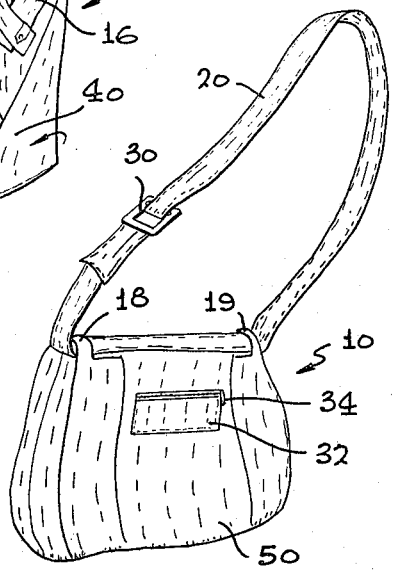
FIG. 3
FIG. 5
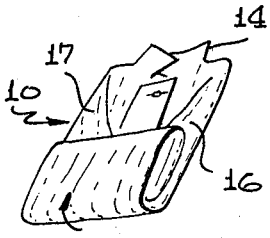
FIG. 2
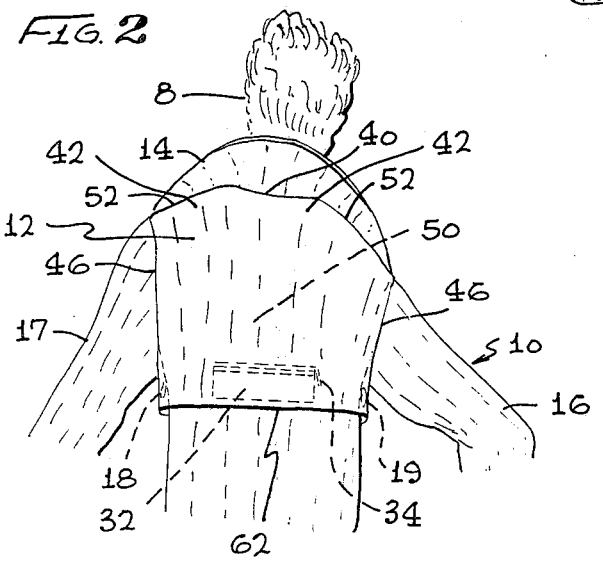
FIG. 6
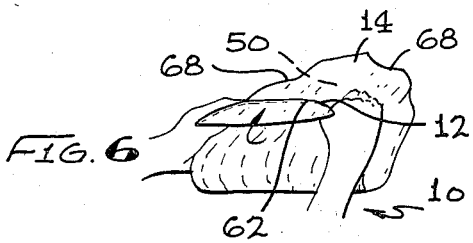
FIG. 7
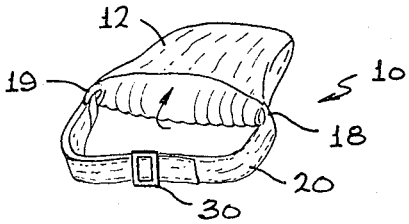

DUAL PURPOSE COAT

BACKGROUND OF THE INVENTION

The present invention relates to dual purpose coats and more specifically to outer coats capable of being worn or folded into the shape of a traveling bag or cushion for convenient storage during travel.

Dual purpose coats have in the past been provided with a self-contained pocket or pouch into which the coat may be inserted for storage. Illustrative of such garments are the coats disclosed in the following patents:

U.S. Pat. No. 1,197,236, Schnur
U.S. Pat. No. 2,058,474, Long
U.S. Pat. No. 2,072,030, Damron
U.S. Pat. No. 2,142,814, Fitch
U.S. Pat. No. 2,143,931, Aronson
U.S. Pat. No. 2,146,243, Aug
U.S. Pat. No. 2,292,347, Bailey
U.S. Pat. No. 2,324,722, Papierniak
U.S. Pat. No. 2,325,494, Fayer
U.S. Pat. No. 2,825,902, Breier
U.S. Pat. No. 3,085,254, Cutler
U.S. Pat. No. 4,055,853, Argento et al.
U.S. Pat. No. 2,208,503, (German Patent)

One problem with these garments is that they require additional items such as zippers and pouches to contain the folded garment, items which add to the cost of the construction of the garment but serve no other useful purpose to the wearer of the coat. Another problem is that some of these garments have a tendency to wrinkle significantly as a consequence of the manner in which they must be folded for storage.

SUMMARY OF THE INVENTION

It is an object of the present invention to provide a new and improved dual purpose coat which does not suffer from these and other problems in the prior art.

Another object of the present invention is to provide a dual purpose coat which can be folded and inserted for storage into the capelette of the coat and which can maintain its storage position without the need for additional closure devices.

Another object of the present invention is to provide a dual purpose coat which can be folded and inserted for storage into a portion of the coat which has uses other than for the mere containment of the folded coat.

Another object of the present invention is to provide a dual purpose coat which can be folded into the shape of a traveling bag which includes an adjustable carrying strap formed from the belt-portion of the coat.

Another object of the present invention is to provide a dual purpose coat which can be conveniently stored for travel in a self-contained pouch in a manner which shields the outer surfaces of the coat from dirt and other stain-producing materials.

A still further object of the present invention is to provide a method for folding an outer garment into the shape of a traveling bag or cushion for convenient storage during travel.

These and other objects of the present invention will be evident from a view of the following detailed description of the preferred embodiment of the present invention, read in association with the accompanying drawings.

BRIEF DESCRIPTION OF THE DRAWINGS

FIG. 1 is a perspective view of the front portion of the present invention shown being worn as an outer coat.

FIG. 2 is a perspective view of the back portion of the present invention illustrating the details of the capelette portion of the coat.

FIG. 3 is a perspective view of the present invention shown folded into the shape of a traveling bag.

FIG. 4 is a perspective view of the present invention illustrating the initial step of the method for converting the coat shown in FIG. 1 into the traveling bag shown in FIG. 3.

FIG. 5 is a perspective view of the present invention illustrating the second step of the method for converting the coat shown in FIG. 1 into the traveling bag shown in FIG. 3.

FIG. 6 is a perspective view of the present invention illustrating the third step of the method for converting the coat shown in FIG. 1 into the traveling bag shown in FIG. 3.

FIG. 7 is a perspective view of the present invention illustrating the final step of the method for converting the coat shown in FIG. 1 into the traveling bag shown in FIG. 3.

DESCRIPTION OF THE PREFERRED EMBODIMENTS

FIG. 1 illustrates the dual purpose coat 10 being worn on a model 8. Coat 10 includes collar 14, right sleeve 16, left sleeve 17, lower portion 22, belt 20, and buckle 30—all constructed and joined according to conventional garment making techniques.

Coat 10 also includes capelette 12. Capelette 12 is of special importance to the subject invention as it not only provides style, protection, and form for the coat while it is being worn, but, as later explained, serves as a pouch-like container for the coat during storage. To facilitate this dual function, only the upper and lateral perimeter edges of capelette 12 are sewn to coat 10. As illustrated in FIG. 2, this means that the center portion 40 of capelette 12's upper perimeter edge is sewn to the bottom rear portion 56 of collar 14, and the outer portions 42 of its upper perimeter edge are sewn to the top shoulder portions 52 of coat 10. Also, its lateral perimeter edges 46 are sewn respectively to the junctions between sleeves 17 and 16 and upper back portion 50 of coat 10. When attached as described, capelette 12 and upper back portion 50 form an inverted pouch.

Lower end 62 of capelette 12 may optionally extend around to the upper front portions 58 of coat 10 and be attached thereto in any type of stylish manner. One such stylish manner is illustrated in FIG. 1.

It is noted that in both FIGS. 1 and 2, lower portion 62 of capelette 12 extends noticably beneath the lower point of the junction between sleeves 17 and 16 and upper portions 58 and 50 of coat 10. In addition to enhancing the stylistic appeal of coat 10, it is believed that this extension helps to relieve stress on the lower ends of the seams between capelette 12 and sleeves 16 and 17 after the coat has been folded into a pouch. Additional protection against tearing may be provided by reinforcing the lateral and perimeter seams of capelette 12 with suitable means such as a double row of stitching.

The amount of material needed for the proper construction of capelette 12 is approximately the same as the amount of material used for the upper back portion 50 of coat 10. Once the upper and lateral perimeter edges of capelette 12 are sewn to coat 10 at the places described above, capelette 12 should neither sag nor be extremely tight while coat 10 is being worn. Rather, it should be of the same tautness as is upper back portion 50 of coat 10.

Coat 10, including capelette 12, may be formed of any conventional coat material such as polyester, nylon, cotton, wool or a blend of such types of materials. For best results, the material should be relatively light in weight and should not be prone to wrinkling when folded. It has been found that a quilted array of polyester fiber filler sandwiched between two relatively thin layers of material is particularly well suited for this purpose.

When it is desired to prepare coat 10 for storage and transport, belt 20 is first withdrawn from the coat. As shown in FIG. 4, collar 14 is then unfolded, and sleeves 16 and 17 and bottom ends 40 and 41 are folded inward so that the width of folded coat 10 throughout its length is approximately the width of the shoulders of the coat, a width illustrated in FIG. 4 by numeral "66".

Next, the lower end of coat 10 is rolled upward towards collar 14 as shown in FIG. 5. The number of times the lower end must be rolled will depend upon the length of coat 10, which, of course, will vary depending upon the particular style of coat to which the subject invention is adopted. Once the lower end is fully rolled upward so that only collar 14 protrudes, the resulting bundle is flipped over in preparation for the final conversion step.

The pouch formed by capelette 12 and upper back portion 50 is then folded inside out as illustrated in FIGS. 6 and 7. In particular, lower end 62 of capelette 12 is pulled upward while upper corners 68 of folded coat 10 are pressed inward towards the center of upper back portion 50. Once lower end 62 of capelette 12 has cleared collar 14, it is pulled down over the front side of folded coat 10 while folded coat 10 is tucked into the inverted pouch which is being formed by capelette 12 and upper back portion 50. The resulting inverted pouch is then pressed into the shape of a traveling bag. Belt 20 may then be used as an adjustable carrying strap for the traveling bag by inserting it through retaining means 18 and 19 and through belt buckle 30. Although retaining means 18 and 19 are illustrated in the form of loops, other suitable retaining means such as hooks or D-rings may also be used. The length of the carrying strap can then be adjusted by adjusting the amount of belt 20 which is threaded through belt buckle 30.

Once folded, the resulting traveling bag requires no fastners to retain its shape. This is partly because of the unique folding process which is used and partly because of the unique structure of capelette 12 and associated back portion 50. It should also be apparent that the surfaces of the traveling bag which are exposed to the environment are surfaces of coat 10 which are not so exposed during the wearing of coat 10. Thus, the outer wearing surfaces of coat 10 are shielded from dirt and other stain producing materials while the coat is folded for storage.

If desired, coat 10 can be provided with a small pocket 32 in the upper back portion 50 of the coat beneath capelete 12 as illustrated in FIG. 2. Pocket 32 may be formed from conventional material suitable for garment pockets, or it may simply be formed by sewing a section of coat liner material (not shown) to the inside surface of upper back portion 50 in a pocket shaped pattern. In either case, pocket 32 will then be available as an accessible storage compartment when coat 10 is converted into a traveling bag as shown in FIG. 3, or as a hidden pocket when coat 10 is in normal use as shown in FIG. 2. Zipper closure 34 may also be provided.

It is also noted that coat 10, once folded, may also function as a cushion in addition to a traveling bag.

It is, of course, to be understood that the abovedescribed structure is merely illustrative and is in no way limiting of the invention as delineated by the claims appended below.

I claim:

1. A foldable coat comprising:

(a) a conventional coat including an upper back portion; and (b) a capelette extending over said upper back portion having its upper and side edges attached to said upper back portion by reinforcing means so as to form with said upper back portion, while attached to said upper back portion and folded back upon itself, a pouch into which the remainder of the coat can be inserted.

2. The foldable coat of claim 1 further including at least two retaining means, each of which is attached to an outer edge of said upper back portion beneath the lower end of said capelette for detachably retaining a carrying strap while said foldable coat is in said foldable state.

3. The foldable coat of claim 2 further including pocket means attached to said upper back portion beneath said capelette for serving as an accessible storage compartment for said foldable coat.

4. The foldable coat of claim 3 further including zipper means for reversably sealing said pocket means.

5. A method of folding a foldable coat having a lower portion, a front upper portion, a rear upper portion, sleeves, and a capelette attached at its upper and lateral perimeter edges to the outer sides of said rear upper portion comprising the steps of:

(a) folding said lower portion and said sleeves directly on top of the outside of said front upper portion; and (b) turning said capelette inside out while stuffing said lower portion and said sleeves into the pouch formed by said capelette and said rear upper portion.

* * * * *